US005839013A

United States Patent [19]

Murasawa et al.

[11] Patent Number: 5,839,013

[45] Date of Patent: Nov. 17, 1998

[54] IMAGE FORMING APPARATUS HAVING A TEST MODE

[75] Inventors: Yoshihiro Murasawa; Seiya Nishiwaki, both of Yokohama, Japan

[73] Assignee: Canon Kabushiki Kaisha, Tokyo, Japan

[21] Appl. No.: 266,689

[22] Filed: Jun. 28, 1994

[30] Foreign Application Priority Data

Jun. 28, 1993 [JP] Japan ..... 5-157023
Jun. 23, 1994 [JP] Japan ..... 6-141997

[51] Int. Cl.[6] ..... G03G 21/00

[52] U.S. Cl. ..... 399/15; 399/46; 399/72; 399/81

[58] Field of Search ..... 355/203, 204, 355/205; 399/15, 46, 72, 81

[56] References Cited

U.S. PATENT DOCUMENTS 4,335,952 6/1982 Conly et al. ..... 355/203
4,448,515 5/1984 Ishikawa ..... 355/313
4,657,375 4/1987 Watanabe et al. ..... 355/308
4,766,464 8/1988 Watanabe et al. ..... 355/204
4,860,048 8/1989 Itoh et al. ..... 355/208
5,243,382 9/1993 Takano et al. ..... 355/203 X
5,365,310 11/1994 Jenkins et al. ..... 355/202

*Primary Examiner*—Nestor R. Ramirez
*Attorney, Agent, or Firm*—Fitzpatrick, Cella, Harper & Scinto

[57] ABSTRACT

An image forming apparatus includes an image forming unit for forming an image on a sheet, mode setting unit for setting a test mode for a detection of a cause for a defect in the formed image, a control unit for causing the image forming means to form a plurality of sample images by changing operating conditions of the image forming unit when the test mode is set by the mode setting unit, an input unit for manually inputting a result of comparison of the plurality of sample images and display unit, wherein the control unit determines the particulars of the detection for the cause of the defect in the formed image or contents of the test mode to be subsequently carried out in response to an input of the input unit and, at the same time, causes the display unit to perform a display of the cause for the defect in the formed image or a display of the contents of the test mode to be subsequently carried out.

24 Claims, 9 Drawing Sheets

IMAGE FORMING APPARATUS HAVING A TEST MODE

BACKGROUND OF THE INVENTION

1. Field of the Invention

This invention relates to the detection of a cause for trouble in an image forming apparatus.

2. Related Background Art

The system of electrophotography has been adopted in such image forming apparatuses as monochromic copying devices, laser beam printers, and color copying devices.

The electrophotography obtains an image by forming on a sensitive material an electrostatic latent image by a process of charging and a process of exposure, converting the latent image into a visible image with a toner by a process of development, then transferring the toner image onto a transfer paper by a process of transfer, and fixing the toner image on the transfer paper.

Since these processes are operated by means of corona discharge, frictional electrification, static electricity, etc., they are not easily enabled to maintain stability of image output and are apt to entail impairment of images as by uneven toner deposition. For safety from this misfortune, the image forming apparatuses are now relying on such measures as periodical check of their performance by servicemen and incorporation therein of wholly exchangeable kits which severally comprise a collection of all component devices necessary for the operation of an unstable process.

In spite of these remedial measures, the image forming apparatuses are still deficient in operational efficiency in respect that when they happen to form images of inferior quality and inevitably undergo servicemen's elaborate check of their performance, the servicemen will expose them to trial operations under varying image forming conditions in search of the causes for trouble.

SUMMARY OF THE INVENTION

This invention has for an object thereof the provision of an image forming apparatus which is liberated from the drawback attendant on the conventional image forming apparatuses as described above.

Another object of this invention is to provide an image forming apparatus which is enabled to enhance its own operational efficiency by allowing a serviceman engaging in the detection of a cause for trouble in the apparatus to tell sequentially which image forming conditions ought to be adjusted.

Still another object of this invention is to provide an image forming apparatus which is enabled to enhance its own operational efficiency by displaying particulars to be checked next in response to the serviceman's input on the outcome of his check.

Other objects of this invention will become apparent from the description given hereinbelow with reference to the annexed drawings and the claims appended hereto.

DETAILED DESCRIPTION OF THE PREFERRED EMBODIMENT

Now, this invention will be described in detail below with reference to the accompanying drawings representing an embodiment of the present invention.

Figure 1:
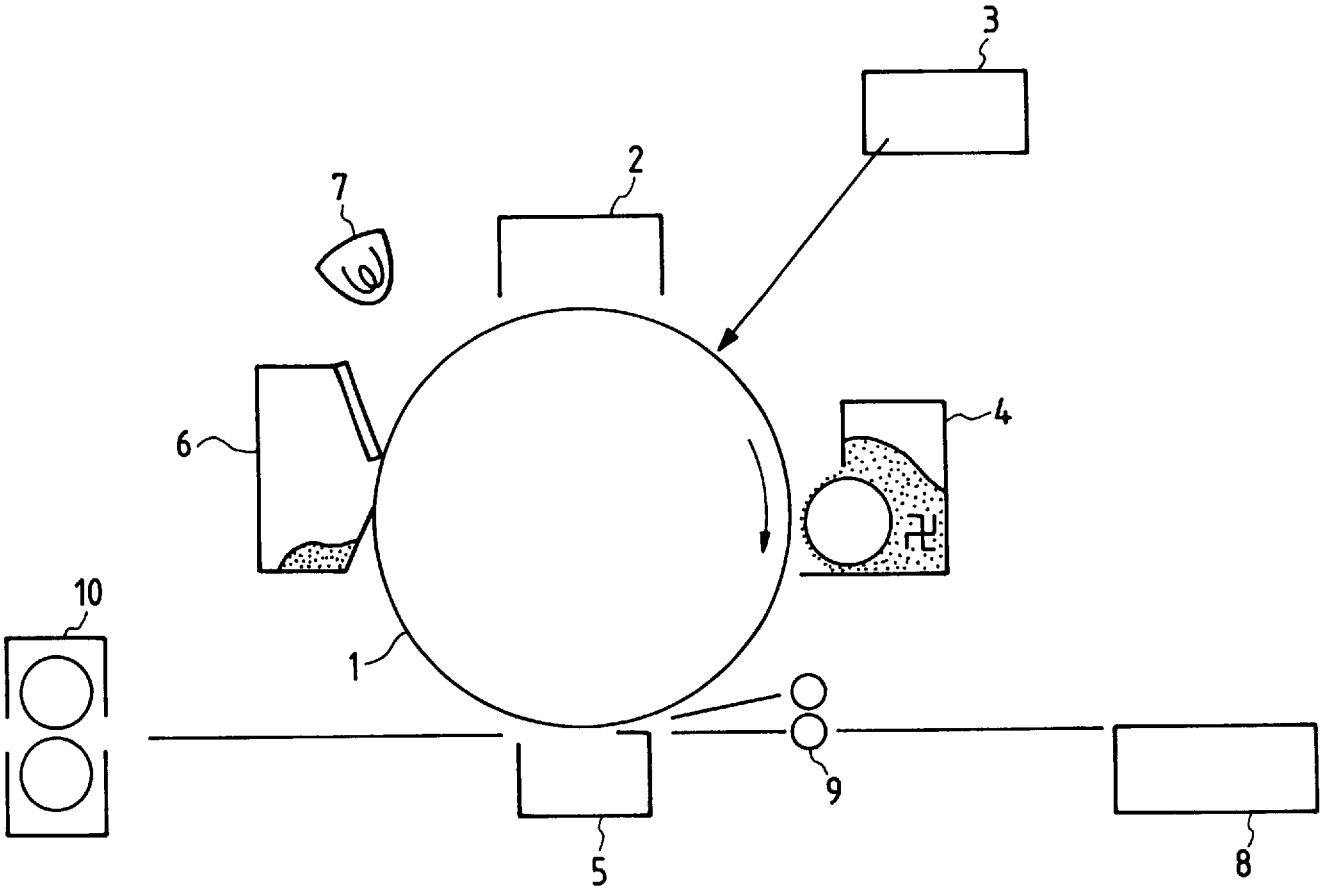
FIG. 1 is a cross section of the essential part of an image forming apparatus embodying this invention.

FIG. 1 is a cross section of an electrophotographic image forming apparatus as one embodiment of this invention.

A sensitive drum 1 made as of selenium, amorphous silicon, or an organic photosensitive substance allows formation of an electrostatic latent image thereon, a primary charger 2 uniformly electrifies the sensitive drum 1 by means of the phenomenon (development) of corona discharge, and an exposure system 3 forms the latent image as by use of a laser beam. A developer 4 renders visible the electrostatic latent image formed on the sensitive drum 1. The developer, for example, adopts the so-called jumping development system which comprises forming a thin layer of a one-component magnetic toner on a developing sleeve, opposing the thin layer closely but not contiguously to the sensitive drum, and applying an AC developing bias and a DC developing bias between the sensitive drum and the sleeve thereby developing the latent image or the two-component developing brush system which comprises forming on a developing sleeve a thin layer of a two-component developer composed of a high-resistant carrier and a toner, opposing the thin layer closely to the sensitive drum, and applying an AC developing bias and a DC developing bias between the sensitive drum and the sleeve thereby developing the latent image. A transfer charger 5 transfers the toner image on the sensitive drum 1 onto a transfer paper. A cleaner 6 in the process of transfer removes toner particles still remaining on the sensitive drum 1. This cleaner, for example, adopts the blade cleaning system which comprises placing an elastic member made as of polyurethane foam in contact with the sensitive drum and causing the elastic member to clean the sensitive drum with a mechanical scraping motion. A preexposure device 7 imparts uniformity to the sensitive drum 1 prior to primary charging. A fixing device 10 fixes the toner image on the transfer paper. The sensitive drum 1 is uniformly electrified by the primary charger 2 and is caused to form an electrostatic latent image thereon by the exposure system 3. This latent image is turned into a visible image by the developer 4. The toner image on the sensitive drum 1 is transferred onto a transfer paper which is supplied by a cassette 8. The transfer paper is conveyed as adjusted to the transfer timing by resist rollers 9. As the transfer paper onto which the toner image has been transferred is conveyed to the fixing device 10, the toner image is fixed on the transfer paper by the fixing device 10. Then, the transfer paper is discharged from the fixing device 10. The toner particles still remaining on the sensitive drum 1 are removed from the sensitive drum 1 by the cleaner 6.

Figure 2:
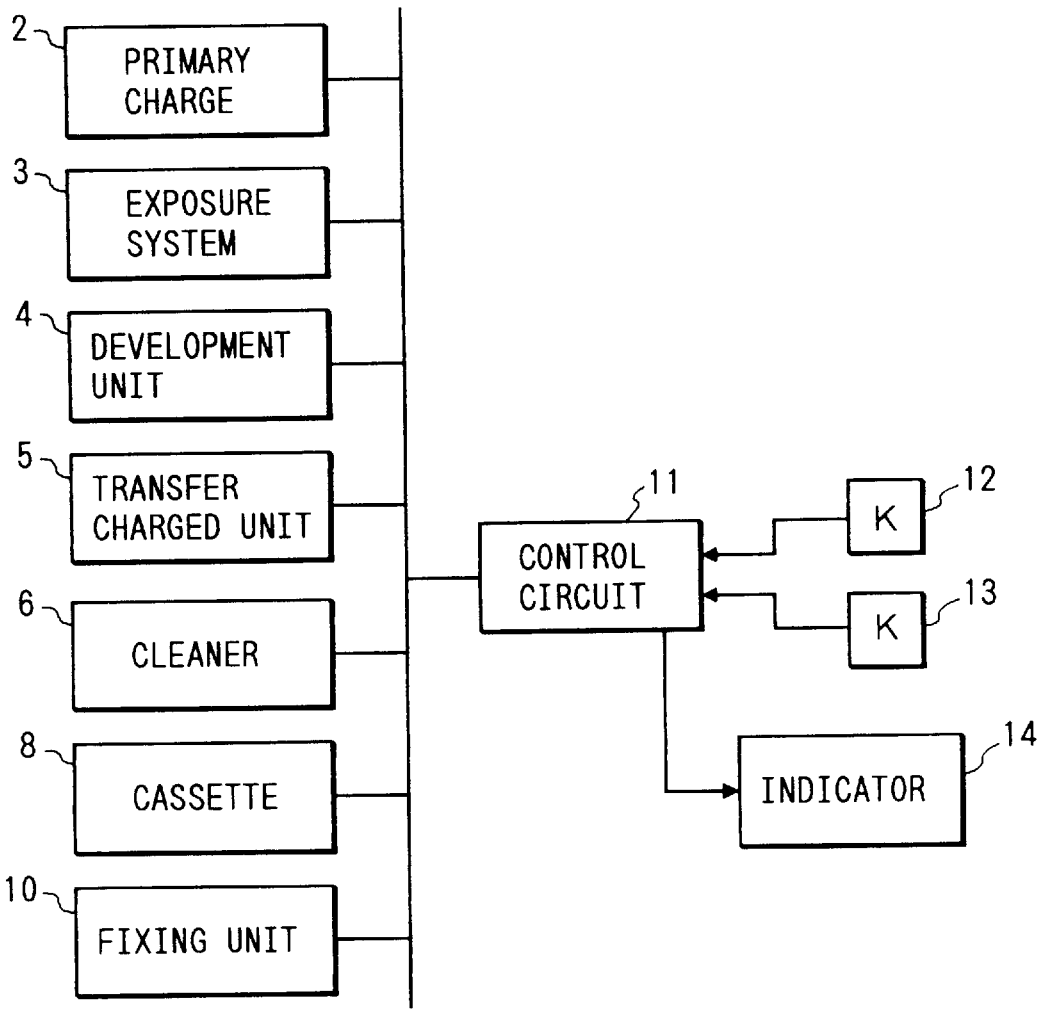
FIG. 2 is a block diagram illustrating the electric circuit of an image forming apparatus embodying this invention.

FIG. 2 is a block diagram illustrating an electric circuit in the present embodiment. A control circuit 11 controls the whole of the apparatus. This control circuit 11 is possessed of a CPU, a ROM storing the procedure for the control effected by the CPU, and a RAM affording a work area for the CPU and is so adapted, during the normal formation of an image, to control the operations of the primary charger 2, the exposure system 3, the developer 4, the transfer charger 5, the cleaner 6, the preexposure device 7, the cassette 8, and the resist rollers 9 in conformity with key inputs introduced through well-known key input circuits 12 and, during the execution of the mode for detection of a cause for such uneven image as will be described hereinbelow, controls the operations of the aforementioned component elements 2, 3, 4, 5, 6, and 10 in response to the key inputs through a selective key input circuit 13. A display 14 has the role of exhibiting various kinds of information.

Figure 3:
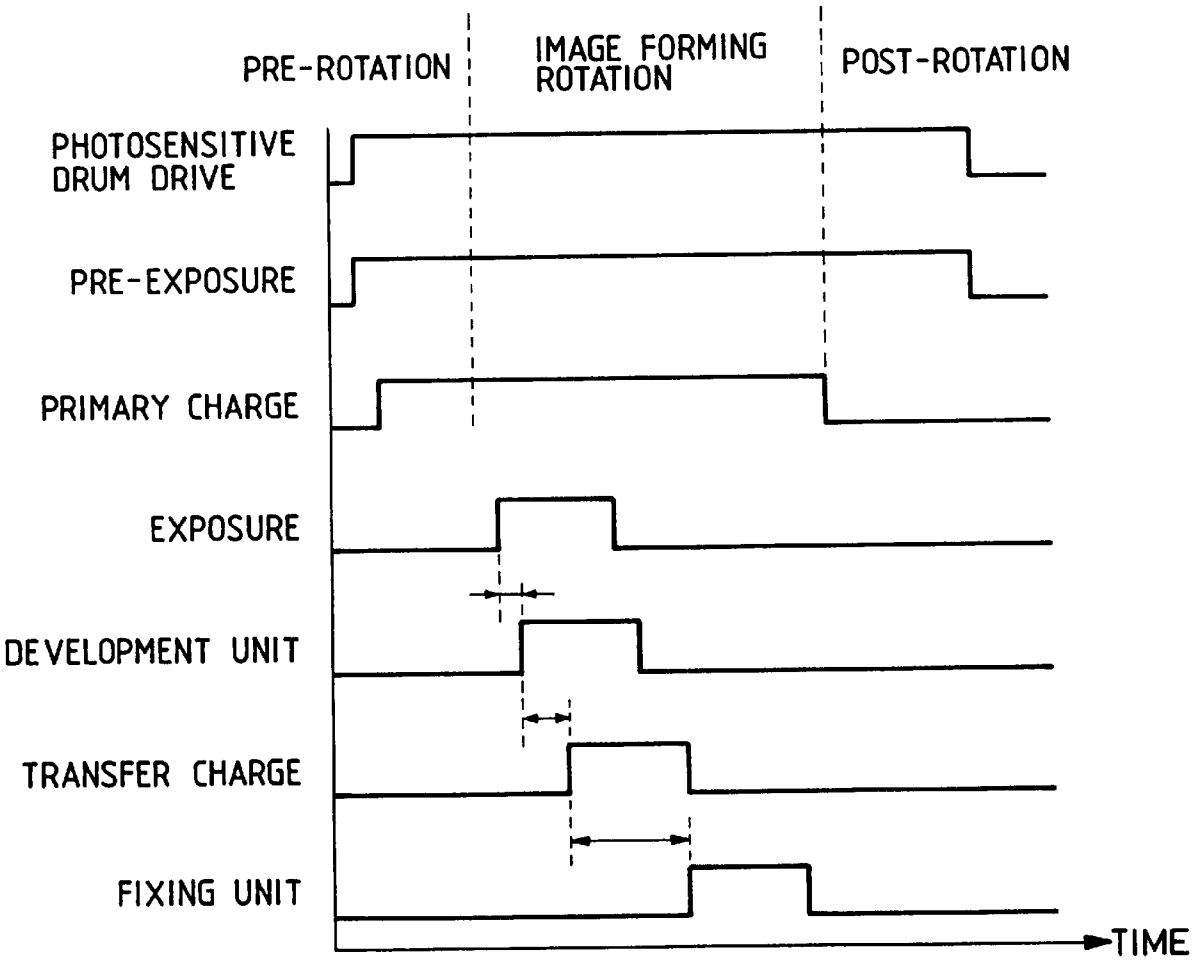
FIG. 3 is a diagram showing the timing chart of the operation of the image forming apparatus.

FIG. 3 is a timing chart illustrating the operation timings of the preexposure device, the primary charger, the exposure system, the developer, the transfer charger, and the fixing device during the normal image formation. Based on the drive of the sensitive drum, the whole operation is divided into the three major phases, namely prerotation, image-forming rotation, and postrotation. The prerotation is intended to stabilize the surface potential of the sensitive drum prior to use and the postrotation to give an aftertreatment to the sensitive drum subsequently to use and prevent the electrostatic latent image from remaining on the sensitive drum. During the image-forming rotation, the steps of exposure, development, transfer, and fixing are sequentially carried out to form the toner image on the transfer paper and discharge the transfer paper.

Uneven images possibly found on transfer papers emanating from the image forming apparatus described above are ascribable to various causes which may be sorted as follows.

1. Uneven exposure due to dirt on the exposure device or on the optical system.
2. Uneven charging due to dirt on the primary charger (discharge wire, grid, and housing).
3. Uneven development due to imperfect application of the developing agent to the developing sleeve.
4. Uneven transfer due to dirt on the transfer charger.
5. Incomplete cleaning of the sensitive drum surface due to lack of intimate contact between the cleaning blade of the cleaner and the sensitive drum surface or clogging of the cleaning blade with toner particles.
6. Uneven fixation of image due to injury on the fixing roller.

In the present embodiment, the selective key input circuit 13 permits introduction of a key input which corresponds to the particular mode for executing such a varying sequence as shown below based on the cause detected for a pertinent form of trouble and the control circuit 11, in response to the key input, proceeds to control the component elements 2 to 6, 8, and 10 as shown below.

A. Sequence of test for uneven exposure

Figure 4:
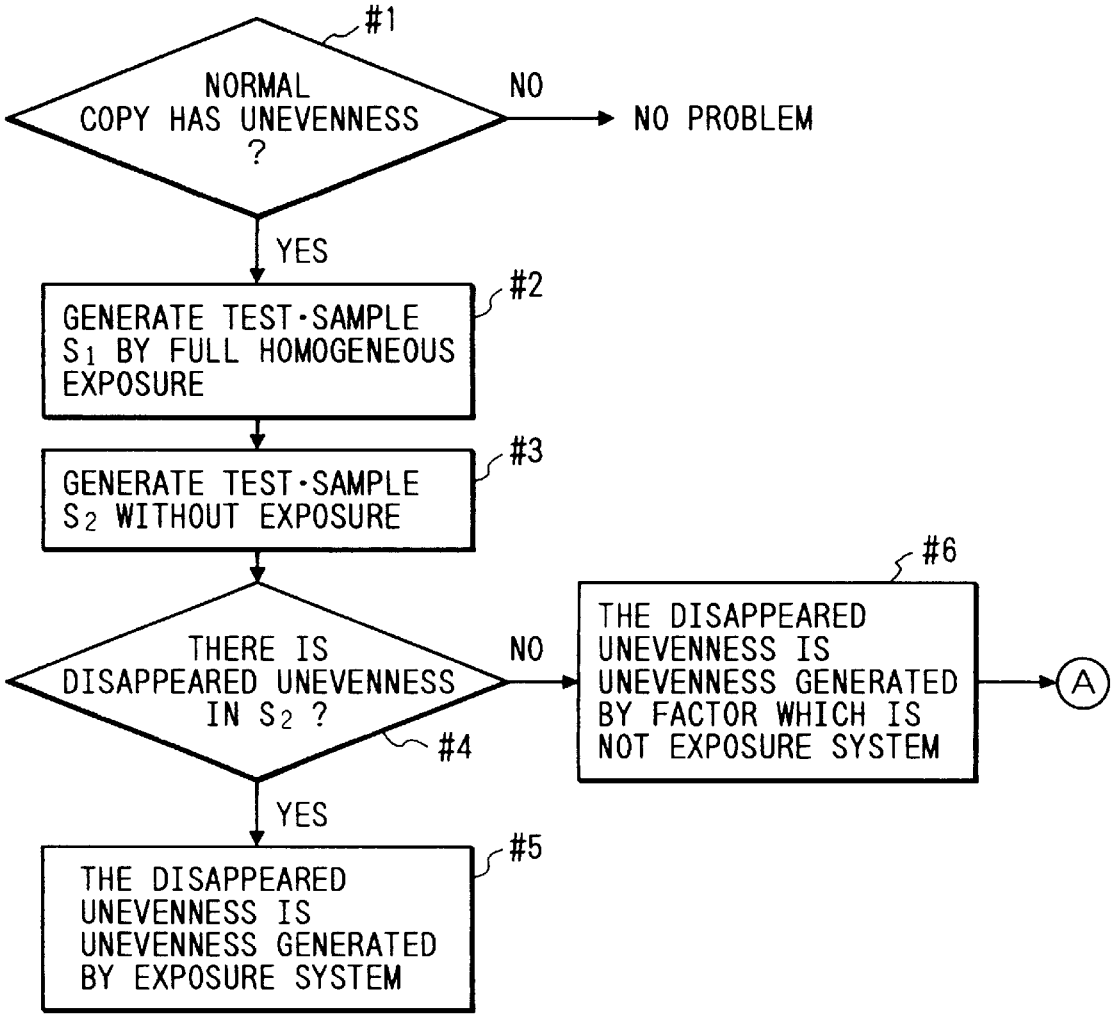
FIG. 4 is a flow chart of the sequence of a test for uneven exposure.

This sequence of test is shown in FIG. 4. When an image formed on a transfer paper by the normal image formation happens to reveal unevenness, the attendant on the apparatus feeds a key for selecting a test for uneven exposure in through the selective key input circuit 13 to start this sequence (#1), allowing the operation timings of preexposure and primary charging to proceed in the same manner as during the normal image formation, producing a test sample $S_1$ (#2) by uniformly exposing the whole surface of the sensitive drum with the exposure system 3, forming a toner image on the sensitive drum, transferring the toner image onto a transfer paper, and fixing the toner image thereon, similarly carrying out the steps of preexposure and primary charging, and producing a test sample $S_2$ (#3) with the light from the exposure system 3 blocked. At the end of this sequence, the attendant compares sample $S_1$ produced by the uniform exposure to the light with the sample $S_2$ produced in the absence of the light and determines whether or not the uneven image is due to uneven exposure. These samples are specifically produced as follows.

(1) Production of whole-surface halftone print by uniform exposure of whole surface to light In case of analog exposure: With a plate of standard density (plate of higher reflection density than the white part) set in a place other than the surface for mounting a subject copy in the scanning area in which a given subject copy is scanned with the light from the exposure optical system and the optical system fastened at the position of the plate of standard density, a transfer paper is exposed in the normal sequence with the optical system to produce a halftone print $S_1$ on the whole surface thereof.

In case of digital exposure: A given transfer paper is irradiated with the laser beam continuously emitted from a laser scanning optical system to produce a copy in the normal sequence. By suitably varying the pulse width of each of the picture elements involved or the laser power for irradiation thereby effecting uniform exposure of the whole surface of the transfer paper, a halftone print $S_1$ is formed on the whole surface of the transfer paper in the normal sequence.

(2) Production of whole-surface halftone print with the blocked light of exposure When the light of exposure is blocked, the developer is normally operated to produce a copy on a given transfer paper with the sensitive drum kept charged to a dark potential $V_D$. In the developer, the developing bias potential $V_{dev}$ fit for deposition of the toner is determined and the potential so fixed is applied to the developing sleeve.

In case of the system of normal development: The system of normal development deposits the toner in an amount inversely proportional to the amount of light used for exposure. In this system, a whole-surface halftone print $S_2$ is formed by use of a developing bias potential $V_{dev}$ which satisfies the formula, $V_D-V_{dev} \geqq V_D-V^0_{dev}$ ($V^0_{dev}$: the magnitude of $V_{dev}$ during normal sequence). The halftone is produced so that the level thereof substantially equals that of the halftone which is formed in the sequence of test of (1).

In case of the system of reversal development: The system of reversal development deposits the toner in an amount directly proportional to the amount of light used for exposure. In this system, a whole-surface halftone print $S_2$ is formed by use of a developing bias potential $V_{dev}$ which satisfies $V_D-V_{dev}<0$ and $|V_D-V_{dev}| \leqq |V_L-V_{dev}|$.

Figure 5:
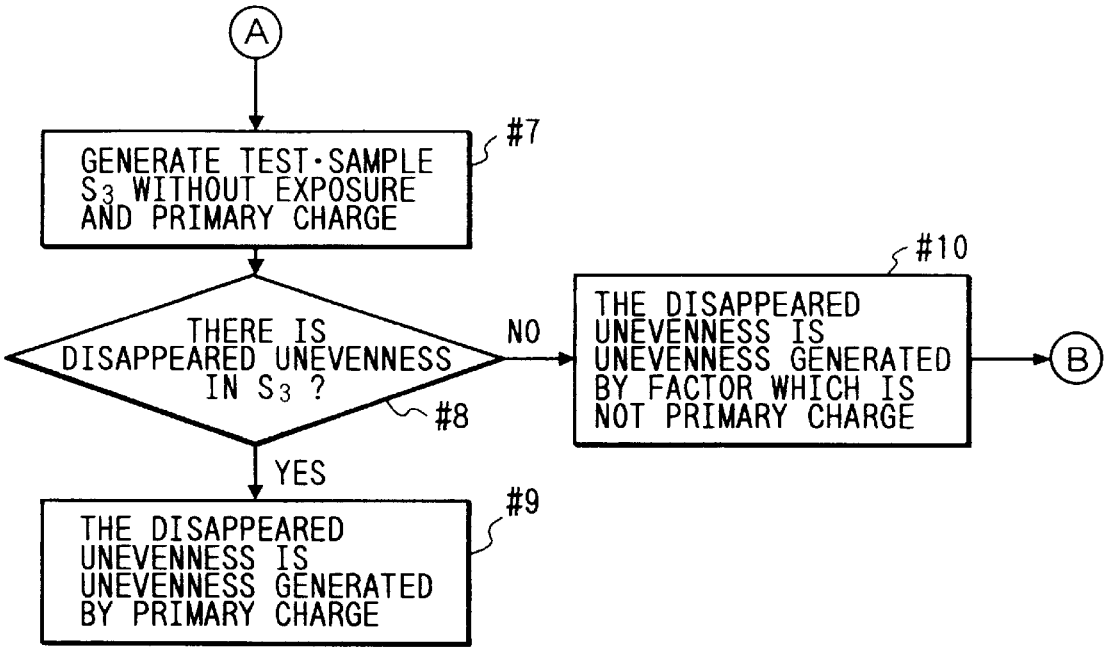
FIG. 5 is a flow chart of the sequence of a test for uneven primary charge.

Then question as to whether or not the test sample $S_1$ reveals unevenness and the test sample $S_2$ reveals a sign of vanished unevenness is exhibited on the display 14. The attendant compares the test samples $S_1$ and $S_2$ obtained in the sequences (1) and (2) mentioned above and feeds the outcome of his judgment (YES or NO) in through the key input part 13 (#4). The cause for the unevenness in the sequence of exposure is discerned by the result of this judgment. When the sample $S_1$ reveals unevenness and the sample $S_2$ reveals a sign of vanished unevenness, this unevenness proves to have been caused during the process of exposure and this judgment is exhibited on the display 14 (#5). If the sample $S_2$ still reveals the unevenness, this unevenness will prove to have been caused at some other position than the exposure system (#6) and the flow of processing will be advanced to the next sequence (FIG. 5). At this time, the fact of this shift to the next sequence is exhibited on the display 14.

B. Sequence of test for uneven primary charging

After the sequence of test for uneven exposure (FIG. 4) has been carried out, other possible causes than that of uneven exposure are searched. This sequence of test is illustrated in FIG. 5. It is started by the attendant feeding in through the selective key input circuit 13 the key for selecting the test for uneven primary charging. Optionally, the apparatus may be so adapted as to start this sequence automatically in response to the attendant's input of "NO" during the sequence of test for uneven exposure. A test sample $S_3$ is produced (#7) by performing the development, with the emission of the light for exposure from the exposure system 3 and the charging of the sensitive drum 1 by the primary charger 2 bothblocked and the drum potential set at 0 V. Then, the question as to whether or not the test sample $S_3$ reveals a sign of vanished unevenness is exhibited on the display 14. The attendant, by comparing the sample $S_3$ with the test sample $S_1$ produced by the whole-surface uniform exposure or the test sample $S_2$ produced in the absence of the light for exposure, discerns whether or not the unevenness revealed in the test sample $S_1$ or $S_2$ is due to uneven primary charging and feeds the outcome of his judgment (YES or NO) in through the selective key input circuit 13 (#8). When the test sample $S_3$ reveals a sign of vanished unevenness, this unevenness proves to have been caused by uneven primary charging and this fact is exhibited on the display 14 (#9). If no sign of vanished unevenness is revealed by the test sample $S_3$, then the unevenness will prove to have been caused by some other factor than the primary charging (#10). Thus, the path of processing is advanced to the next sequence (FIG. 6) and this fact is exhibited on the display 14.

Incidentally, the test sample $S_3$ is specifically produced as shown below.

In case of the system of normal development: A whole-surface halftone print $S_3$ is produced by use of a developing bias potential $V_{dev}$ which satisfies the formulas, $V_{dev}<0$ and $|V_{dev}|<V_{D1}-V^{O}_{dev}$. This halftone is such that the level thereof is substantially equal to that of the halftones of the samples $S_1$ and $S_2$.

In case of the system of reversal development; A whole-surface halftone print $S_3$ is formed by use of a developing bias potential $V_{dev}$ which satisfies the formula, $V_{dev}<|V_L-V_{dev}|$.

C. Sequence of test for uneven development

Figure 6:
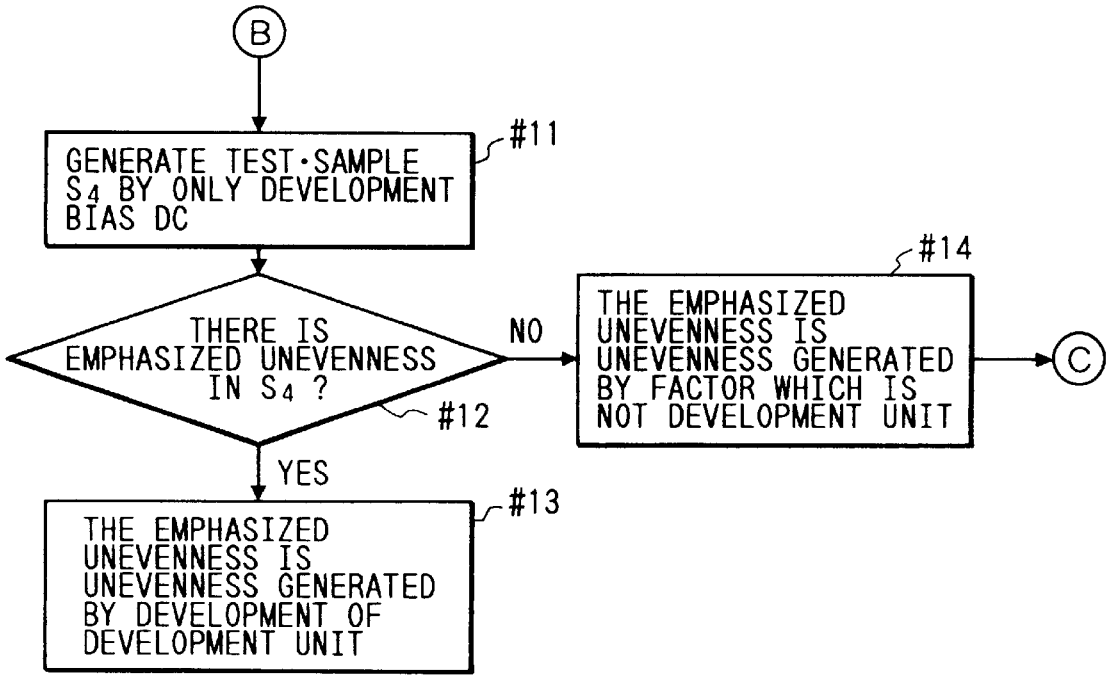
FIG. 6 is a flow chart of the sequence of a test for uneven development.

In the process of development with the developer 4, the alternating developing biases (AC+DC) are applied between the sensitive drum 1 and the developing sleeve as described above for the purpose of promoting the action of development. These alternating developing biases have the function of alleviating the unevenness of the thin layer of toner formed on the developing sleeve. By removing the AC component from these developing biases, the unevenness of the thin film mentioned above is exaggerated so as to surpass that of the image. This sequence of test is illustrated in FIG. 6. It is started by the attendant feeding in through the selective key input circuit 13 the key for selecting the test for uneven development. The apparatus may be otherwise adapted to start this sequence of test automatically in response to the attendant's input of NO in the sequence of test for uneven primary charging. A test sample $S_4$ is produced (#11) in the same manner as the sample $S_2$ excepting the DC component alone of the developing biases is used in the developer 4. Then, the question as to whether or not this test sample S reveals exaggerated unevenness is exhibited on the display 14. The attendant, by comparing this test sample $S_4$ with the test sample $S_2$, discerns whether or not the sample $S_4$ is revealing the exaggerated unevenness and feeds the outcome of his judgment (YES or NO) in (#12). In the test sample $S_4$ which is formed of a latent image of dots produced as by use of the laser exposure system, the unevenness is not quite conspicuous. This test sample $S_4$, therefore, is desired to be compared with the test sample $S_2$, for example. Since the exclusion of the AC bias component in the developer 4 entails a proportionate decrease of the image density, the DC component of the developing bias, the primary current, etc. must be adjusted for the purpose of matching the levels of density.

When the test sample $S_4$ reveals exaggerated unevenness at the step #12, this unevenness proves to have been originated in the unevenness of the developing agent in the developer 4 and this fact is exhibited on the display 14 (#13). Conversely, if no exaggerated unevenness is revealed, the unevenness on each of the samples under comparison will prove to have been caused at some place other than the developer 4 (#14). Thus, the path of processing is advanced to the next sequence (FIG. 7) and this fact is exhibited on the display 14.

D. Sequence of test for uneven transfer

The process of transfer comprises causing a given transfer paper to adhere fast to the sensitive drum 1 and, at the same time, causing the toner image on the sensitive drum 1 to be transferred onto the transfer paper by virtue of an electric field generated by corona discharge. The main cause for the unevenness encountered in the process of transfer originates in the unevenness of corona discharge due to dirt.

Figure 7:
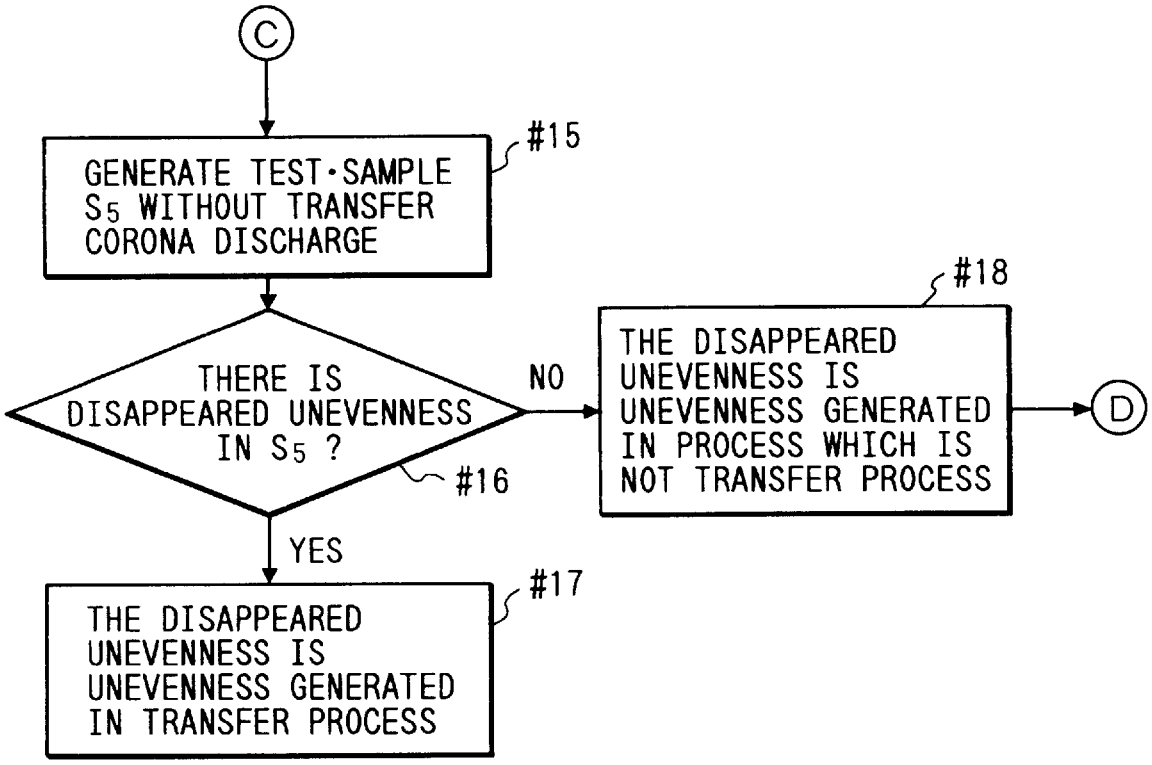
FIG. 7 is a flow chart of the sequence of a test for uneven transfer.
Figure 10:
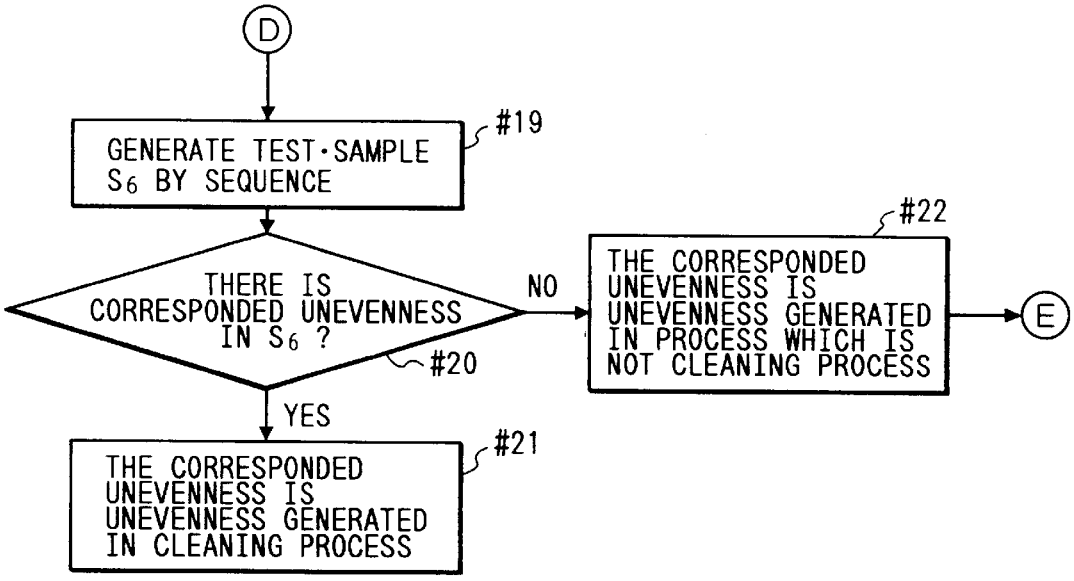
FIG. 10 is a flow chart of the sequence of a test for uneven cleaning.

This sequence of test is illustrated in FIG. 7. It is started by the attendant feeding in through the selective key input circuit 13 the key for selecting the test for uneven transfer. The apparatus may be otherwise adapted to start this sequence of test automatically in response to the attendant's input of NO in the sequence of test for uneven development. A test sample $S_5$ is produced (#15) in the same manner as the test sample $S_1$ excepting the effect of the corona discharge on the process of transfer is eliminated by cancelling the corona discharge in the transfer charger 5 and limiting the process of transfer to mechanical fast adhesion of the transfer paper to the sensitive drum 1. Then, the question as to whether or not the test sample $S_5$ reveals a sign of vanished unevenness is exhibited on the display 14. The attendant compares this test sample $S_5$ with the test sample $S_1$ to discern whether or not the sample $S_5$ has a sign of vanished unevenness and feeds the result of his judgment (YES or NO) in through the selective key input circuit 13 (#16). When the sample $S_5$ has a sign of vanished unevenness, this unevenness proves to have been caused by the unevenness of transfer charging and this fact is exhibited on the display 14 (#17). Conversely, if no sign of vanished unevenness is revealed, this unevenness proves to have been caused in a process other than the process of transfer (#18). Thus, the path of processing is advanced to the next sequence of test (FIG. 10) and this fact is exhibited on the display 14.

Figure 8:
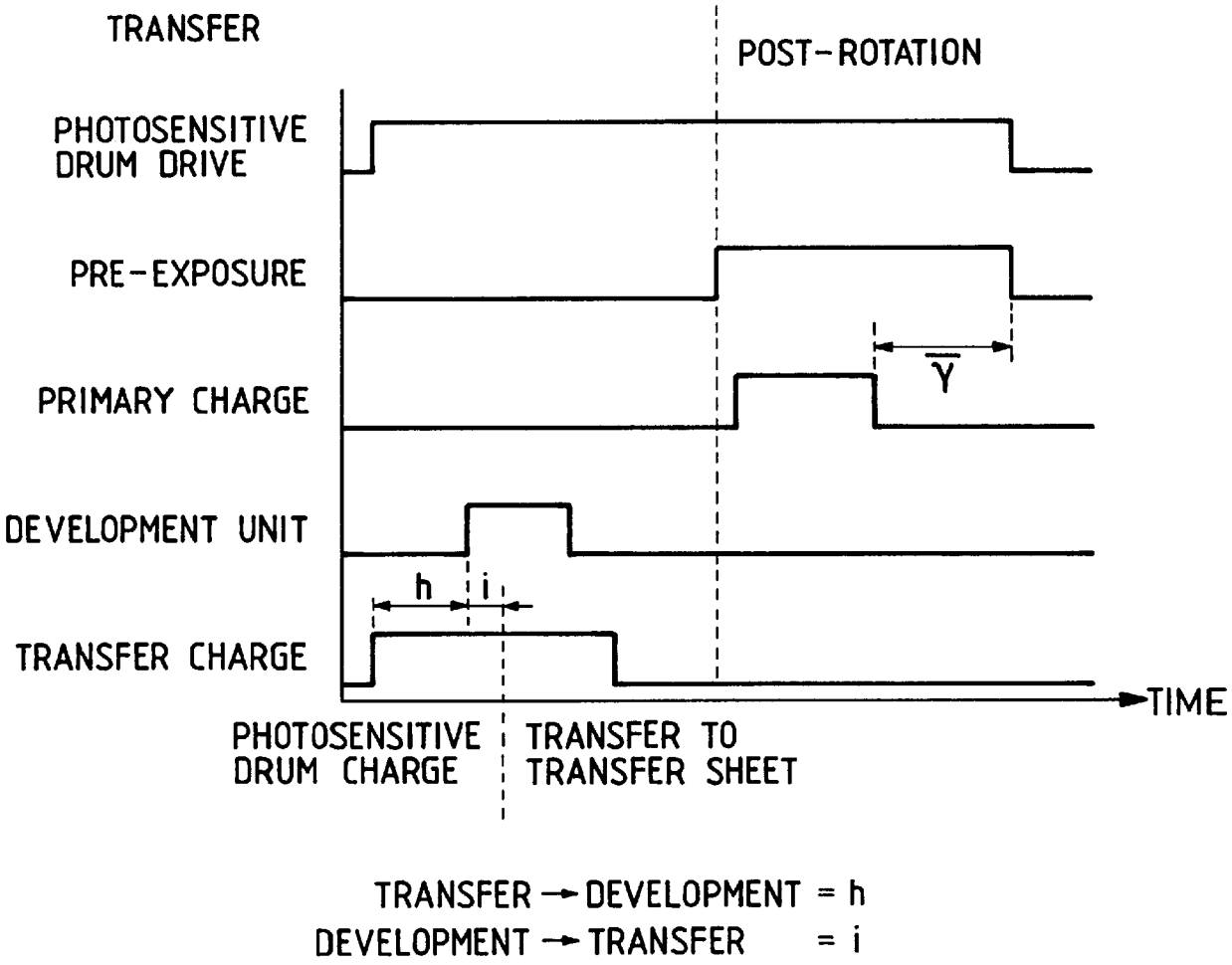
FIG. 8 is a timing chart of the sequence of a test for uneven transfer.

Alternatively, the detection of the unevenness of transfer charging may be attained by a method which comprises charging the sensitive drum 1 with the transfer charger 5 and, on the assumption that this charge constitutes itself a latent image on the sensitive drum 1, developing this assumed latent image, transferring the developed image onto a transfer paper, and searching the consequently formed image for unevenness. FIG. 8 represents a timing chart of the operation of this method. To be specific, the transfer charger 5 is operated in harmony with the drive of the sensitive drum 1 without being preceded by the steps of preexposure and primary charging, the sensitive drum 1 is uniformly charged with the transfer charger 5, and the latent image on the sensitive drum 1 is uniformly developed and then transferred onto a transfer paper. In FIG. 8, h stands for the time which intervenes between the time the sensitive drum 1 is charged by the transfer charger 5 and the time the latent image is developed by the developer 4 and i for the time which intervenes between the time the latent image is developed by the developer 4 and the time the developed image is transferred onto the transfer paper by the transfer charger 5. When the unevenness revealed by the test sample obtained by this process coincides with that of the test sample $S_1$, this unevenness proves to have been caused by the unevenness of transfer charging.

E. Sequence of test for uneven cleaning process

The unevenness for which the process of cleaning is responsible arises during the step in which the cleaning blade of the cleaner 6 is pressed against the sensitive drum 1 and caused to scrape off the sensitive drum 1 the toner particles still remaining thereon after the transfer of the toner image. Uneven contact of the cleaning blade with the sensitive drum 1 results in imperfect scraping of the toner particles, namely the so-called defective cleaning of the sensitive drum 1.

Figure 9:
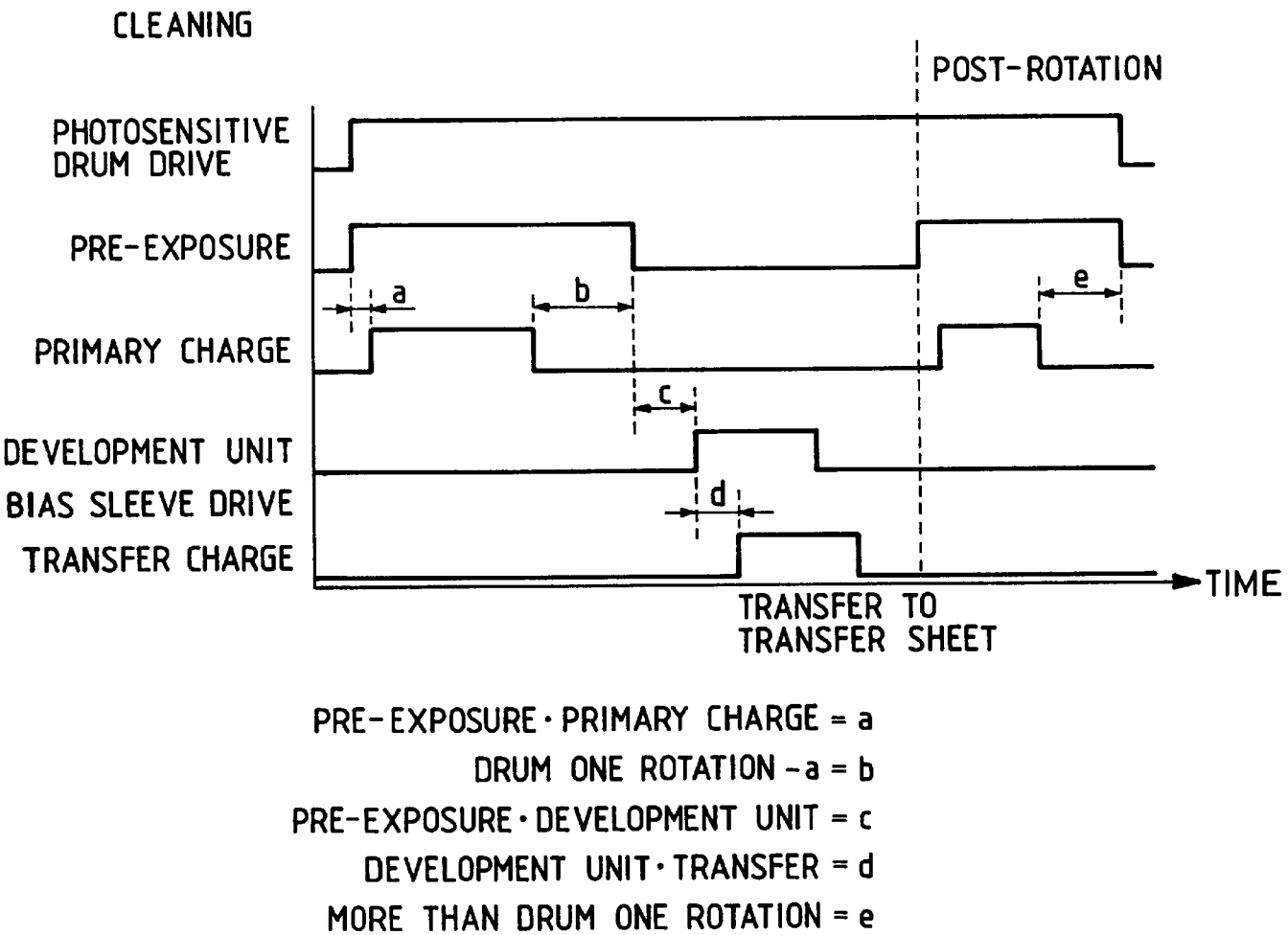
FIG. 9 is a timing chart of the sequence of a test for uneven cleaning.

The state of this uneven contact of the cleaning blade can be judged by checking the condition of frictional electrification which is generated between the sensitive drum 1 and the cleaning blade. FIG. 9 represents a timing chart of the sequence of test under discussion and FIG. 10 a flow chart of the operation involved therein. This sequence is started by the attendant feeding in through the selective key input circuit 13 the key for selecting the test for the unevenness due to the cleaning process. Optionally, the apparatus may be adapted to start this sequence of test automatically in response to the attendant's input of NO in the sequence of test for uneven transfer. When the surface of the sensitive drum 1 which has been uniformly leveled in consequence of the preexposure effected by the primary charger 2 subsequently to the primary charging passes the cleaning blade, it is vested with an electrostatic pattern which is generated by the frictional electrification due to the contact thereof with the cleaning blade. This pattern can be developed into a visible image by the developer 4 without undergoing the primary charging. In FIG. 9, a stands for the time intervening between the start of the preexposure and the primary charging, b for the time preceding the termination of the primary charging (one rotation of the drum 1 - a), c for the time intervening between the termination of the preexposure and the arrival of the drum 1 at the developer 4, d for the time intervening between the departure of the drum 1 from the developer 4 and the arrival thereof at the transfer charger 5, and e for the time required by the sensitive drum 1 in producing at least one complete rotation.

A test sample $S_6$ representing the unevenness due to the process of cleaning in a visible pattern is produced on a transfer paper as described above (FIG. 10, #19). Then, the question as to whether or not the unevenness revealed by the test sample $S_6$ coincides with that revealed by the test sample $S_1$ is exhibited on the display 14. The attendant compares the test sample $S_6$ with the test sample $S_1$ and feeds in through the selective key input circuit 13 the result of his judgment (YES or NO) to permit discernment of the unevenness in association with the step of cleaning (#20). When the unevenness of the test sample $S_6$ coincides with that of the test sample $S_1$, it proves to have been caused by the process of cleaning (#21). If they do not coincide, the unevenness of each of the two samples will prove to have been caused at some place other than the cleaning process (#22). Thus, the path of processing is advanced to the next sequence (FIG. 11) and this fact is exhibited on the display 14.

F. Sequence of test for uneven fixing process

The process of fixing resides in fixing a toner image on a transfer paper by virtue of the heat which emanates from the fixing rollers kept warm by the heater of the fixing device 10 and the pressure which arises between the fixing rollers. The unevenness for which the process of fixing is responsible originates in maldistribution of mechanical pressure or impaired surface smoothness of the fixing rollers due to migration of toner particles from the transfer paper to the roller surfaces.

Figure 11:
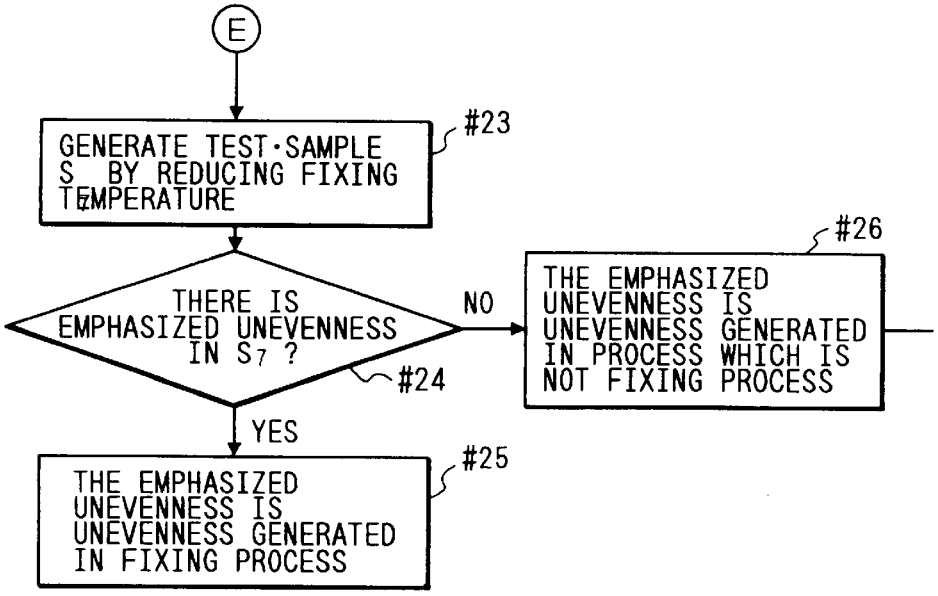
FIG. 11 is a flow chart of the sequence of a test for uneven fixing.

Normally, the temperature of the fixing rollers is so fixed as to absorb the maldistribution of pressure between the fixing rollers and the impaired surface smoothness of the fixing rollers due to migration of toner particles from the transfer paper to the roller surfaces. By setting the temperature of the fixing rollers at the lower limit of the range of temperatures which permit effective fixation of the toner image, the maldistribution of pressure and the impaired surface smoothness due to migration of toner particles from the transfer paper to the roller surfaces are exaggerated. This sequence of test is started by the attendant feeding in through the selective key input circuit 13 the key for selecting the test for uneven fixing process. Optionally, the apparatus may be adapted to start this sequence of test automatically in response to the attendant's input of NO in the sequence of test for uneven cleaning. A test sample $S_7$ is produced with the temperature of the fixing rollers lowered from the normal level (FIG. 11, #23). Then, the question as to whether or not the test sample $S_7$ reveals exaggerated unevenness is exhibited on the display 14. The attendant compares the test sample $S_1$ with the test sample $S_7$ and feeds in through the selective key input circuit 13 the result of his judgment (YES or NO). He proceeds to discern whether or not the test sample $S_7$ reveals the exaggerated unevenness (#24). When the exaggerated unevenness is revealed, this unevenness proves to have been caused in the process of fixing (#25). If no exaggerated unevenness is revealed, this unevenness proves to have been produced at some place other than the fixing device 10 and this fact is exhibited on the display 14 (#26).

The sequences of test described above do not need to be unexceptionally executed. They may be suitably selected for the sake of execution by feeding in through the selective key input circuit 13 such an identifying symbol as a number which is assigned to the individual sequence of test.

Optionally, image reading means such as the CCD may be installed on the downstream side of the fixing device 10 and operated for the purpose of reading images of test samples produced on transfer papers which are discharged from the fixing device 10 and effecting the detection of unevenness based on the images so read out. This construction allows all the sequences of test to be automatically carried out without requiring the attendant to compare test samples and feed in the result of his judgment into the apparatus.

It is to be distinctly understood that this invention is not limited to the preferred embodiment shown and described above but may be otherwise variously embodied and practiced within the scope of the following claims.

What is claimed is:

1. An image forming apparatus, comprising:

image forming means for forming an image on a sheet;

mode setting means for setting a test mode for a detection of a cause for a defect in the formed image;

control means for causing said image forming means to form a plurality of sample images by changing operating conditions of said image forming means when the test mode is set by said mode setting means;

input means for manually inputting a result of comparison of the plurality of sample images by an operator;

and display means, wherein said control means discriminates whether or not the cause of the defect in the formed image can be specified on the basis of the input from said input means, and wherein when the cause cannot be specified, determines a content of a test mode to be subsequently carried out, and when the cause can be specified, displays the specified cause on said display means.

2. An image forming apparatus according to claim 1, wherein said control means causes said display means to display a method for comparison of the plurality of sample images.

3. An image forming apparatus according to claim 1, wherein said control means causes said image forming means to form the sample images based on the contents of the test mode to be subsequently carried out in response to the input of said input means.

4. An image forming apparatus according to claim 1, wherein said image forming means forms images by an electrophotographic process and said control means causes said image forming means to form the sample images without causing a sensitive member to be exposed to a light.

5. An image forming apparatus according to claim 1, wherein said image forming means forms images by an electrophotographic process and said control means causes said image forming means to form sample images without causing a sensitive member to be electrified.

6. An image forming apparatus according to claim 1, wherein said image forming means forms images by an electrophotographic process and said control means causes said image forming means to form the sample images by eliminating the AC component of a developing bias.

7. An image forming apparatus according to claim 1, wherein said image forming means forms images by an electrophotographic process and said control means causes said image forming means to form the sample images without the electrification for a transfer.

8. An image forming apparatus according to claim 7, wherein said control means further causes to form a third sample image by operating said exposure means and to form a fourth sample image without operating said exposure means.

9. An image forming apparatus according to claim 7, wherein said control means further causes to form a third sample image by operating said charging means and to form a fourth sample image without operating said charging means.

10. An image forming apparatus according to claim 7, wherein said control means further causes to form a third sample image in the presence of the DC bias component of said developing means and to form a fourth sample image in the absence of the DC bias component of said developing means.

11. An image forming apparatus according to claim 7, wherein said control means further causes to form a third sample image in the presence of a discharge to be effected by said transfer means and to form a fourth sample image in the absence of discharge by said transfer means.

12. An image forming apparatus according to claim 1, wherein said image forming means forms images by an electrophotographic process and said control means causes said image forming means to form the sample images based on a frictional electrification caused by the cleaning of a sensitive member.

13. An image forming apparatus according to claim 1, wherein said image forming means forms images by an electrophotographic process and said control means causes said image forming means to form the sample images at a lowest temperature for a fixation.

14. An image forming apparatus, comprising:

image forming means for forming an image on a sheet;

setting means for setting a test mode for a detection of a cause for a defect in a formed image;

control means for executing a first test sequence for forming a first sample image by operating said image forming means under a first operating condition and a second test sequence for forming a second sample image by operating said image forming means under a second operating condition when the test mode is set by said mode setting means; and reading means for reading the first sample image and the second sample image, wherein said control means determines contents of the test mode to be subsequently carried out by comparing the first sample image and the second sample image which are read out by said reading means.

15. An image forming apparatus according to claim 14, wherein said control means further executes the determined contents of the test mode.

16. An image forming apparatus, comprising:

image forming means for forming an image on a sheet;

setting means for setting a test mode for a detection of a defect in a formed image;

control means for executing a first test sequence for forming a first sample image by operating said image forming means under a first operating condition and a second test sequence for forming a second sample image by operating said image forming means under a second operating condition when the test mode is set by said mode setting means;

inquiry means for inquiring of an operator about a result of comparison between the first sample image and the second sample image;

input means for manually inputting the reply to an inquiry made by said inquiry means; and determining means for determining the cause for the defect in the formed image based on the reply input by said input means.

17. An image forming apparatus comprising:

image forming means provided with charging means for charging a sensitive member, exposure means for exposing to a light the sensitive member charged by said charging means, developing means for developing with a toner a latent image formed on the sensitive member exposed to a light by said exposure means, transfer means for transferring onto a sheet a toner image developed by said developing means, and fixing means for fixing on the sheet the toner image transferred by said transfer means:

mode setting means for setting a test mode different from the normal mode of image formation; and control means for causing said image forming means to form a plurality of sample image with at least one operating conditions of each means of said image forming means varied from those used during a normal image formation when the test mode is set by said mode setting means, wherein said control means causes to form a first sample image by operating said fixing means at a first temperature and to form a second sample image by operating said fixing means at a second temperature lower than the first temperature.

18. A test method of an image forming apparatus, comprising the steps of:

a) setting a test mode for a detection of a cause of a defect in a formed image;

b) forming a plurality of sample images in different forming conditions;

c) deciding a result of comparison of the plurality of sample images input manually by an operator;

d) discriminating whether or not the cause of the defect in the formed image can be specified on the basis of a result decided in said deciding step;

e) determining a content of a test mode to be sequentially carried out when the cause cannot be specified; and f) displaying the specified cause when the cause can be specified.

19. A method according to claim 18, further comprising a step of displaying a comparison method of the plurality of sample images.

20. A test method of an image forming apparatus, comprising the steps of:

a) setting a test mode for a detection of a cause of a defect in a formed image;

b) forming a plurality of sample images in different forming conditions;

c) reading the plurality of sample images formed in said forming step;

d) comparing the plurality of sample images read in said reading step; and e) determining contents of a test mode to be sequentially carried out, on the basis of a result of comparison in said comparing step.

21. A test method according to claim 20, further comprising a step of executing the contents of the test mode determined in said determining step.

22. A test method of an image forming apparatus, comprising the steps of:

a) setting a test mode for a detection of a cause of a defect in a formed image;

b) forming a plurality of sample images in different conditions;

c) inquiring of an operator about a result of comparison of the plurality of sample images formed in said forming step;

d) deciding a manual reply of the operator for the inquiring in said inquiring step; and e) determining the cause of the defect in the formed image according to a result determined in said deciding step.

23. A method according to claim 22, wherein when the cause of the defect in the formed image can not be determined, a test mode to be sequentially carried out is determined.

24. A method according to claim 22, further comprising a step of displaying a comparison method of the plurality of sample images.

* * * * *

UNITED STATES PATENT AND TRADEMARK OFFICE

CERTIFICATE OF CORRECTION

PATENT NO. : 5,839,013

DATED : November 17, 1998

INVENTORS : Yoshihiro Murasawa, et al.

It is certified that error appears in the above-identified patent and that said Letters Patent is hereby corrected as shown below:

COLUMN 2

Line 25, "as" should be deleted; and
Line 31, "as" should be deleted.

COLUMN 4

Line 16, "With" should read --with--;
Line 25, "A" should read --a--;
Line 42, "The" should read --the--; and
Line 57, "Then" should read --Then, the--.

COLUMN 5

Line 21, "bothblocked" should read --both blocked--;
Line 42, "A" should read --a--; and
Line 48, "A" should read --a--.

COLUMN 6

Line 11, "as" should be deleted.

COLUMN 7

Line 46, "quently" should read --quent-- and "passes" should read --passing--.

UNITED STATES PATENT AND TRADEMARK OFFICE

CERTIFICATE OF CORRECTION

PATENT NO. : 5,839,013

DATED : November 17, 1998

INVENTORS : Yoshihiro Murasawa, et al.

It is certified that error appears in the above-identified patent and that said Letters Patent is hereby corrected as shown below:

COLUMN 11

Line 4, "image" should read --images--; and
Line 5, "conditions" should read --condition--.

Signed and Sealed this

Twenty-fourth Day of October, 2000

*Attest:*

Q. TODD DICKINSON

*Attesting Officer*

*Director of Patents and Trademarks*